United States Patent [19]

van der Toorn

[11] Patent Number: 5,025,803

[45] Date of Patent: Jun. 25, 1991

[54] DEVICE FOR BREAKING OFF PILES

[75] Inventor: Aart van der Toorn, Noordwijk, Netherlands

[73] Assignee: Persluchtcentrale B.V., Netherlands

[21] Appl. No.: 429,113

[22] Filed: Oct. 30, 1989

[30] Foreign Application Priority Data

Oct. 31, 1988 [NL] Netherlands ..... 8802660

[51] Int. Cl.[5] ..... B28D 1/32

[52] U.S. Cl. ..... 125/23.01; 125/40

[58] Field of Search ..... 125/23 R, 23 C, 36, 125/40, 42

[56] References Cited

U.S. PATENT DOCUMENTS 4,480,627 11/1984 van der Toorn ..... 125/23 R

FOREIGN PATENT DOCUMENTS 3515735 1/1987 Fed. Rep. of Germany ..... 125/36

8400404 2/1984 Netherlands .

*Primary Examiner*—Frederick R. Schmidt

*Assistant Examiner*—M. Rachuba

*Attorney, Agent, or Firm*—Skjerven, Morrill, MacPherson, Franklin & Friel

[57] ABSTRACT

The invention relates to a device for breaking off piles, said device being provided with a frame and at least one cutter which is movable to and fro in its longitudinal direction by means of a setting cylinder supported by the frame. The cutter is guided in an elongated passage, whose boundary wall is shaped such that at at least one location between the boundary wall of the passage and the outer circumference of the cutter there is present a recess extending in the longitudinal direction of the cutter and being open at both sides.

8 Claims, 2 Drawing Sheets

DEVICE FOR BREAKING OFF PILES

The invention relates to a device for breaking off piles, said device being provided with a frame and with at least one cutter which is movable to and fro in its longitudinal direction by means of a setting cylinder supported by the frame.

Such a device is for example known from U.S. Pat. No. 4,480,627.

Said known device is quite satisfactory by itself, but practice has shown that especially when the cutter is guided in an elongated passage surrounding the cutter omnilaterally there is a danger that material will find its way into the space between the inner wall of the passage and the outer circumference of the cutter and will cause the cutter to seize at that location.

According to the invention this can be prevented in a simple and efficient manner in that the cutter is guided in an elongated passage, whose boundary wall is shaped such that at at least one location between the boundary wall of the passage and the outer circumference of the cutter there is provided a recess extending in the longitudinal direction of the cutter and being open at both sides.

It is noted that from FR-A-2,514,271 there is known a punching device wherein the punch is provided, spaced by some distance from its free end, with a bush having a larger external diameter than the punch. The punch is thereby guided in a guide means provided with a passage which is equal to the external diameter of the bush provided on the punch. Said passage joins a passage extending transversely to and having a larger diameter than said passage, which passage is connected to an exhaust device. In the raised position of the punch the bush will be located inside said passage having a larger diameter, and the lower end of the punch will be located inside the former passage having a smaller diameter, such that between the boundary wall of said smaller passage and the lower end of the punch there will be present a circular clearance. There is no longer any guiding of the punch in said passage having a smaller diameter in that case. Said device does not have a recess extending in the longitudinal direction of the passage in the spirit of the present invention, therefore.

Also Su-A-1285-115 discloses a device for breaking off piles, said device being provided with setting cylinders supported by a frame. This known device does not have a recess extending in the longitudinal direction of the cutter for discharging any dirt which finds its way between the cutter and the wall guiding the cutter, either.

The invention will be further explained hereafter with reference to an embodiment of the construction according to the invention illustrated in the accompanying figures.

Figure 1:
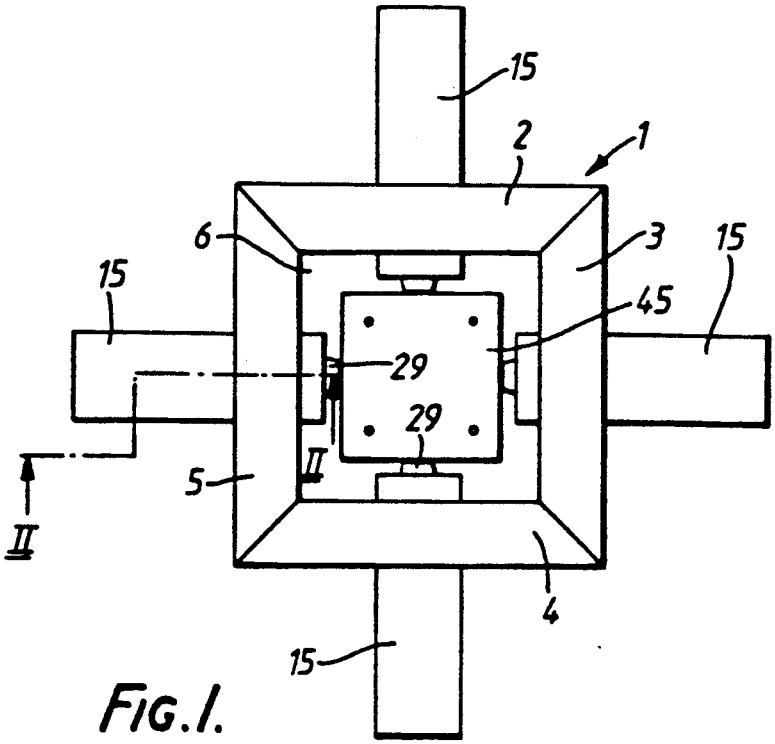
FIG. 1 is a diagrammatic plan view of a device according to the invention.

The device illustrated in FIG. 1 comprises a frame 1 which is built up of four hollow frame beams 2–5 having a rectangular section, the bevelled outer ends of said frame beams being welded together in the manner illustrated in FIG. 1, such that said frame beams 2–5 form a square frame which bounds a passage 6.

Figure 3:
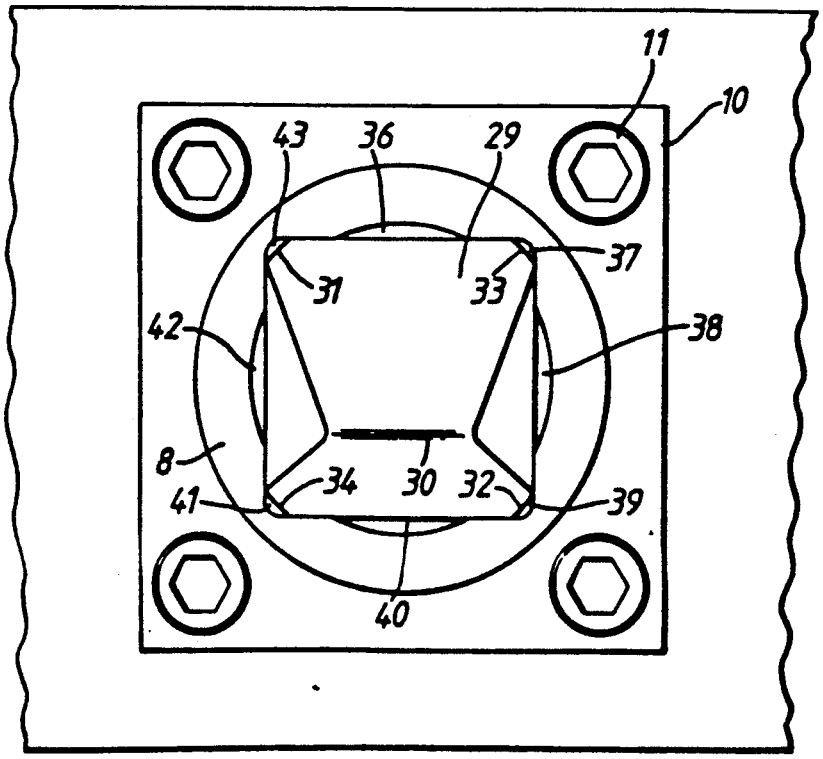
FIG. 3 is a view of FIG. 2, seen according to the arrow III in FIG. 2.
Figure 2:
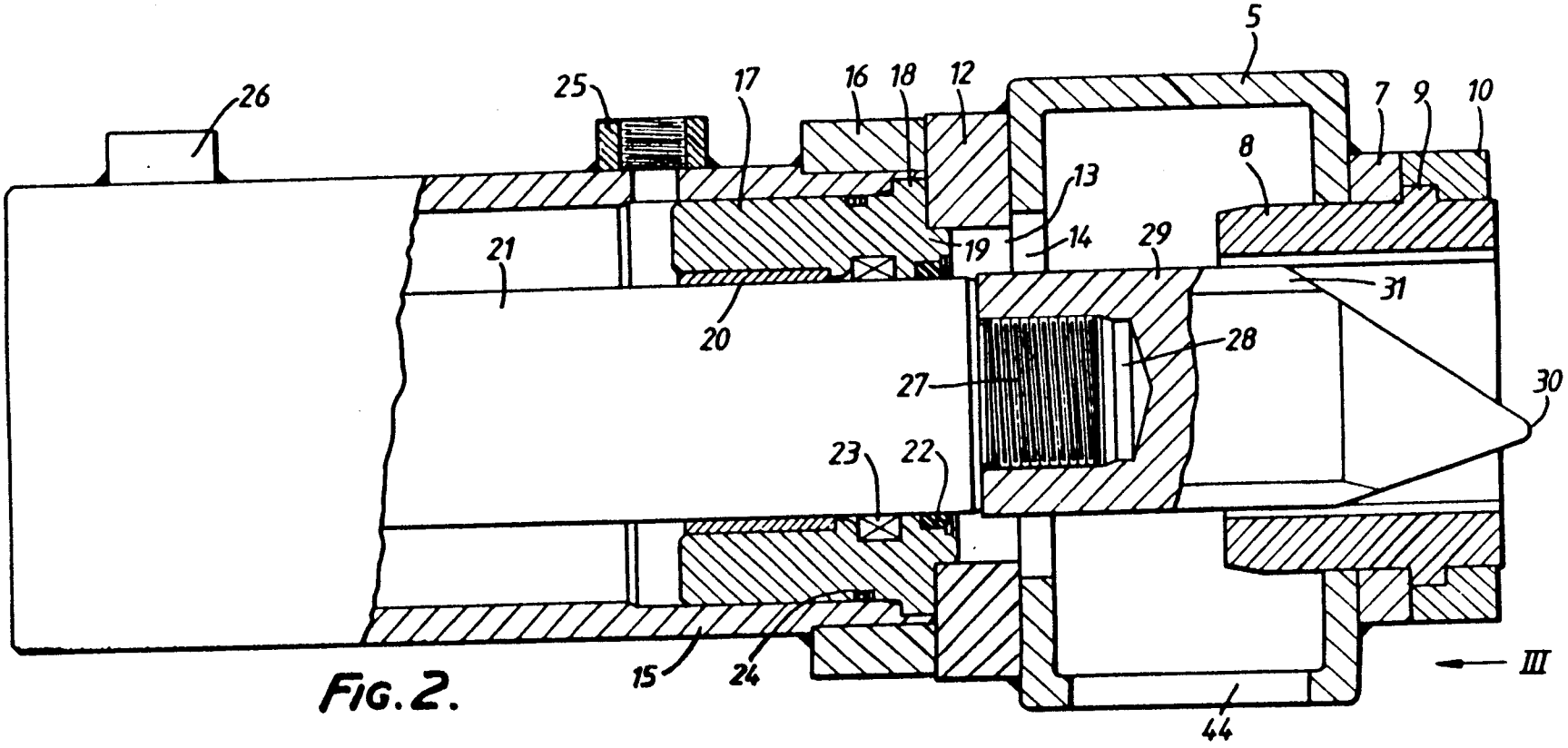
FIG. 2 is a larger-scale section of a part of FIG. 1, seen along the line II—II in FIG. 1.

As is illustrated in more detail in FIG. 2 a stiffening plate 7, which has a square outer circumference in the illustrated embodiment, and in whose centre there is provided a circular hole which lies in the extension of a hole located in the relevant wall of the hollow frame beam, is provided on that side of each of the frame beams 2–5 which bounds the passage 6. Both holes accommodate an elongated bush 8. The bush 8 is provided with a projecting collar 9, which butts against the side of the plate 7 remote from the frame beam 5, and is clamped against said plate 7 by means of a clamping plate 10, which at its side directed towards the plate 7 is provided with a groove for accommodating the circular rib 9. The clamping plate 10 is fixed to the plate 7 by means of four bolts 11, as illustrated in FIG. 3.

To the side of the frame beam 5 remote from the stiffening plate 7 there is secured a stiffening plate 12 provided with a bore 13, which is located co-axially relative to the central axis of the bores in the stiffening plate 7 accommodating the bush 8 and the web of the beam 5 butting against said stiffening plate 5. A bore 14, likewise being located co-axially relative to said central axis, is provided in the body of the beam 5 against which the clamping plate 12 is welded. The diameter of the bore 14 is a little larger thereby than the diameter of the bore 13 thereby.

A cylinder 15 is secured, at its end remote from its closed end, to a mounting plate 16, said mounting plate being provided with a bore accommodating the relevant end of the cylinder 15. The plate 16 thereby has a rectangular, square shape, similar to the plate 10, and the plate 16 is fixed to the stiffening plate 12 by means of bolts (not shown).

The arrangement is thereby such that the central axis of the cylinder 15 coincides with the central axes of the bores 13 and 14 and with the central axes of the bores in the plate 7 and the relevant web of the frame beam 5 accommodating the bush 8.

A bush 17 is pressed in the end of the cylinder 15 secured to the plate 16, said bush at one end being provided with a projecting circular collar 18, which is accommodated in a correspondingly shaped circular recess in the end of the cylinder 15 and is confined between the stiffening plate 12 and the relevant end of the cylinder 15.

A projecting nose part 19 of the bush 17 is inserted in the hole 13 provided in the plate 12.

In the bush 7 there is furthermore provided a guide bush 20 for guiding a piston rod 21 extending in the longitudinal direction of the cylinder 15, said piston rod being secured to a piston (not shown) which is present in the cylinder. In the interior of the bush 17 there are furthermore provided gaskets or sealing means 22 and 23 surrounding the piston rod 21.

In the outer circumference of the bush 17 there is furthermore provided a circular groove for accommodating a sealing means 24 provided between the outer circumference of the bush 17 and the inner wall of the cylinder 15. The cylinder 15 is furthermore provided with stubs 25 and 26 for the connection of pipes intended for the supply and/or discharge of fluid for moving the piston rod 21, with the piston connected thereto, in the longitudinal direction of the cylinder 15.

The end of the piston rod 21 projecting beyond the bush 17 has a projecting part 27, which has a smaller diameter than the other part of the piston rod 21, and is provided with external screw thread. Said projecting threaded part 27 is screwed in a threaded blind bore 28, which is provided in a cutter 29.

As appears in particular from FIG. 3 said cutter has a substantially square cross-section, whilst the cutter, at its end remote from the cylinder 15, tapers into a cutting edge 30, which extends parallel to one of the boundary planes of the cutter, spaced from the longitudinal axis of said cutter, whilst the length of said cutting edge is also slightly less than the width of said cutter, which is the result of the opposed boundary planes of the end of the cutter extending towards the cutting edge 30 in a direction towards one another.

As will be apparent in particular from FIG. 3, the diameter of the passage provided in the bush 8 is larger than the distance between two opposed sides of the cutter, but smaller than the distance between two diagonally opposed flattened corner points 31, 32, and 32, 33, respectively, of the cutter.

For accommodating said corner points there are consequently provided corresponding grooves, extending in the longitudinal direction of the bush 8 and having a substantially triangular section, as will be apparent from FIG. 3. The cutter is therefore only guided through the bush 8 by the boundary walls of said grooves, extending perpendicularly to one another, near the flattened corner points 31–34 of the cutter.

As a result of this construction a plurality of recesses 36–43, extending in the longitudinal direction of the bush 8, are formed between the inner circumference of the guiding passage for the cutter in the bush 8 and the outer circumference of the cutter, said recesses extending between the space 6 enclosed by the frame beams 2–5 and the interior of the frame beams in question. As furthermore appears from FIG. 2 a hole 44 is provided in the lower boundary wall of each of the frame beams, near the bush 8.

The above-described device can be moved over a concrete pile 45 in the manner which is also expounded in the above-mentioned U.S. Pat. No. 4,480,627, such that said pile will come to lie in the space enclosed by the frame beams 2–5. Then said pile can be worked by means of the cutters 29 by moving said cutters to and fro by means of the piston rods 21 and the pistons connected thereto.

By using the above construction, wherein the cutter, having a square section, is only supported near its flattened corner points 31–34, seizing of the cutter due to dirt finding its way between the outer circumference of the cutler and the inner cIrcumference of the bush 8 Is practically excluded. Any dirt finding its way between said parts from the enclosed space 8, such as concrete chippings or the like, can be discharged through the recesses 35–43 to the hollow frame beams 2–5, from where the dirt will move out through the holes 44.

By slackening the bolts 11 the ring 8 with the cutter and the piston rod 21 connected thereto can be pivoted about the central axis of the piston rod 21, for adjusting the cutting edge 30 in a desired position. It will also be possible to fix the bush 8 relative to the plate 10, after which, for adjusting the cutting edge of the cutter 30 in various positions, the plate 10 can be pivoted through 90° into the one or the other direction, or through 180°, and be fixed again relative to the relevant frame beam.

The guide bush 8 for the cutter can easily be replaced, if necessary, since it is only necessary to unscrew the plate 10 in order to do so. Also the cylinder 15 can easily be provided and removed by using the above arrangement, so that the device is easy to assemble and disassemble, and worn-out parts or parts which need repair can easily be exchanged.

Of course the construction according to the invention cannot only be used in a device wherein the frame is formed by frame beams which are fixed together, but the frame of the device may also be built up of detachably connected parts, as is for example described in the Dutch patent application 8400404.

I claim:

1. A device for breaking off piles, said device being provided with a frame and at least one cutter having a square section and bevelled corners, said cutter being movable to and fro in its longitudinal direction by means of a setting cylinder supported by the frame, said cutter being guided in an elongated passage in said frame, a boundary wall of said passage being shaped such that recesses are formed between the boundary wall of the elongated passage and said bevelled portions on the corners of the cutter, said recesses extending in the longitudinal direction of the cutter and extending along the elongated passage.

2. A device according to claim 1, characterized in that the elongated passage is provided in a bush, which is adjustably connected about its longitudinal axis to the frame.

3. A device according to claim 1, characterized in that the elongated passage extends through part of a hollow frame beam forming part of the frame, said frame beam at its lower side being provided with an opening.

4. A device according to claim 1 characterized in that the cutter is guided in a bush which is fixed to the side of a frame beam forming part of the frame, through which frame beam the bush extends along at least part of its length.

5. A device according to claim 4, characterized in that the setting cylinder is detachably secured to a side of the frame beam which is located opposite the side of a having the frame beam to which the bush is fixed.

6. A device according to claim 5, characterized in that a piston pin of the setting cylinder is guided, near one end of the cylinder, through a bush located inside the cylinder housing, said bush being provided with a projecting collar which is confined between one end of the cylinder housing and a frame part to which the cylinder housing is detachably secured.

7. A device according to claim 6, characterized in that the bush located inside the cylinder housing is provided with a projecting nose which is inserted into a frame part.

8. A device according to claim 1 in which said frame is rectangular and includes elongated passages on each side of the frame, one of said cutters being guided in each of said elongated passages and wherein said recesses are formed between boundary walls of said elongated passages and adjacent pairs of said bevelled corners of said cutters.

* * * * *

UNITED STATES PATENT AND TRADEMARK OFFICE

CERTIFICATE OF CORRECTION

PATENT NO. : 5,025,803
DATED : June 25, 1991
INVENTOR(S) : Aart van der Toorn

It is certified that error appears in the above-identified patent and that said Letters Patent is hereby corrected as shown below:

Column 2, line 21, "stiffening plate 5" should be --stiffening plate 7--.

Column 3, line 49, "cutler" should be --cutter--.

Column 3, line 49, "cIrcumference" should be --circumference--.

Column 4, line 44, "a having" should be deleted.

Signed and Sealed this

Sixth Day of July, 1993

*Attest:*

Michael K. Kirk

MICHAEL K. KIRK

*Attesting Officer*

*Acting Commissioner of Patents and Trademarks*